United States Patent [19]

Martin et al.

[11] 4,010,835

[45] Mar. 8, 1977

[54] MATRIX PRINT HEAD

[75] Inventors: Blair Robertson Martin, Owego; Johann Hans Meier, Vestal, both of N.Y.

[73] Assignee: International Business Machines Corporation, Armonk, N.Y.

[22] Filed: Aug. 1, 1975

[21] Appl. No.: 600,985

[52] U.S. Cl. ..... 197/1 R; 101/93.05; 101/93.37; 197/58

[51] Int. Cl.[2] ..... B41J 3/04

[58] Field of Search ..... 197/1 R, 56–59; 101/93.04, 93.05, 93.37–93.40, 109, 110; 346/1, 141, 139; 178/23, 30, 33, 34

[56] References Cited

UNITED STATES PATENTS

| | | | |
|---|---|---|---|
| 2,457,133 | 12/1948 | Deloraine | 197/1 R |
| 3,209,681 | 10/1965 | Sanborn | 197/1 R X |
| 3,223,029 | 12/1965 | Simshauser | 197/1 R X |
| 3,565,000 | 2/1971 | Yeiser | 101/93.37 |
| 3,625,142 | 12/1971 | Bresler | 197/1 R X |
| 3,757,346 | 9/1973 | Holland | 346/1 |
| 3,759,359 | 9/1973 | Stellmach | 101/93.05 X |
| 3,839,957 | 10/1974 | DeLeuze et al. | 101/93.37 |
| 3,900,094 | 8/1975 | Larsen et al. | 197/1 R |

*Primary Examiner*—Ralph T. Rader
*Attorney, Agent, or Firm*—Paul M. Brannen

[57] ABSTRACT

A serial matrix printer has a print head mounted to move along a print line. The print head has means to change the relative vertical positions of some of the print wires with respect to the others. A first embodiment uses a pair of wire guides arranged so that one is translatable with respect to the other, thereby altering the relationship of the wires in the one guide with respect to the other, and a second embodiment employs a rotatable guide which positions the wires at angles such that the desired spatial relation between the wires is obtained.

7 Claims, 6 Drawing Figures

MATRIX PRINT HEAD

FIELD OF THE INVENTION

This invention relates generally to matrix wire printers, and particularly to a wire matrix print head arranged to provide two different printing arrays, whereby the printed output can have different characteristics.

DESCRIPTION OF THE PRIOR ART

Serial printers of the type utilizing a matrix of print wires selectively operated to create characters on documents are well known in the art.

Also, it is readily apparent that with print wires closely spaced in the vertical direction, the character lines can be formed by sequences of dots which form substantially solid lines, thereby enhancing the appearance of the printing. On the other hand, high-speed printing is sometimes desirable with a concomitant reduction in the print quality or appearance. Usually any given printer is designed for one or the other of the two objectives, namely high quality or high speed, and the art does not teach any manner in which these qualities can be selectively controlled to provide the two different types of printing in one single print apparatus.

SUMMARY OF THE INVENTION

It is a principal object of the present invention to provide an improved matrix printer employing arrays of print wires which may be selectively positioned to provide either high-quality or high-speed printing characteristics.

A more particular object of the present invention is to provide an improved wire matrix printer in which the print wires are encased in guides which are positionable so as to provide printed characters having different quality values.

Still another object of the present invention is to provide an arrangement of the kind described in which the print wires are guided by set of wire guides displaceable with respect to each other.

A further object of the invention is to provide a system of the kind described in which a set of wire guides for the matrix is arranged to be rotated to specified angular positions to provide different print qualities.

Other objects of the invention and features of novelty and advantages thereof will become apparent from the detailed description to follow, taken in connection with the accompanying drawings.

In practicing the invention, a wire matrix print head is configured so that the print wires are carried by one or more print wire guides arranged so that the printing ends of the wires can be disposed in two different arrays with respect to the document on which the printing is to take plce. In the first arrangement, the print wires are aligned such that a substantially solid vertical line is formed by proper actuation of the print wires, that is to say, the impressions left by the print wires overlap such that to the eye they appear as a solid line. When the print wire guides are suitably disposed in another relationship, then the print wires are arrayed with respect to each other such that the spacing between the impressions made by the print wires is in accordance with the more conventional type of fragmentary character associated with wire printing. In a first embodiment of the invention, the print wires are contained in two guides, one of which can be translationally displaced in a vertical direction from the other guide which is held in a fixed position. In a second embodiment of the invention, the wires are arranged in a single wire guide which can be rotated about an axis which is perpendicular to the document and parallel to the print wires, the angular relationships being such that suitable array configurations are obtained.

The foregoing and other objects, features and advantages of the invention will be apparent from the following more particular description of preferred embodiments of the invention, as illustrated in the accompanying drawings.

GENERAL DESCRIPTION OF THE DRAWINGS

In the drawings.

Similar reference characters refer to similar parts in each of the several views.

DESCRIPTION OF A FIRST PREFERRED EMBODIMENT

Figure 1:
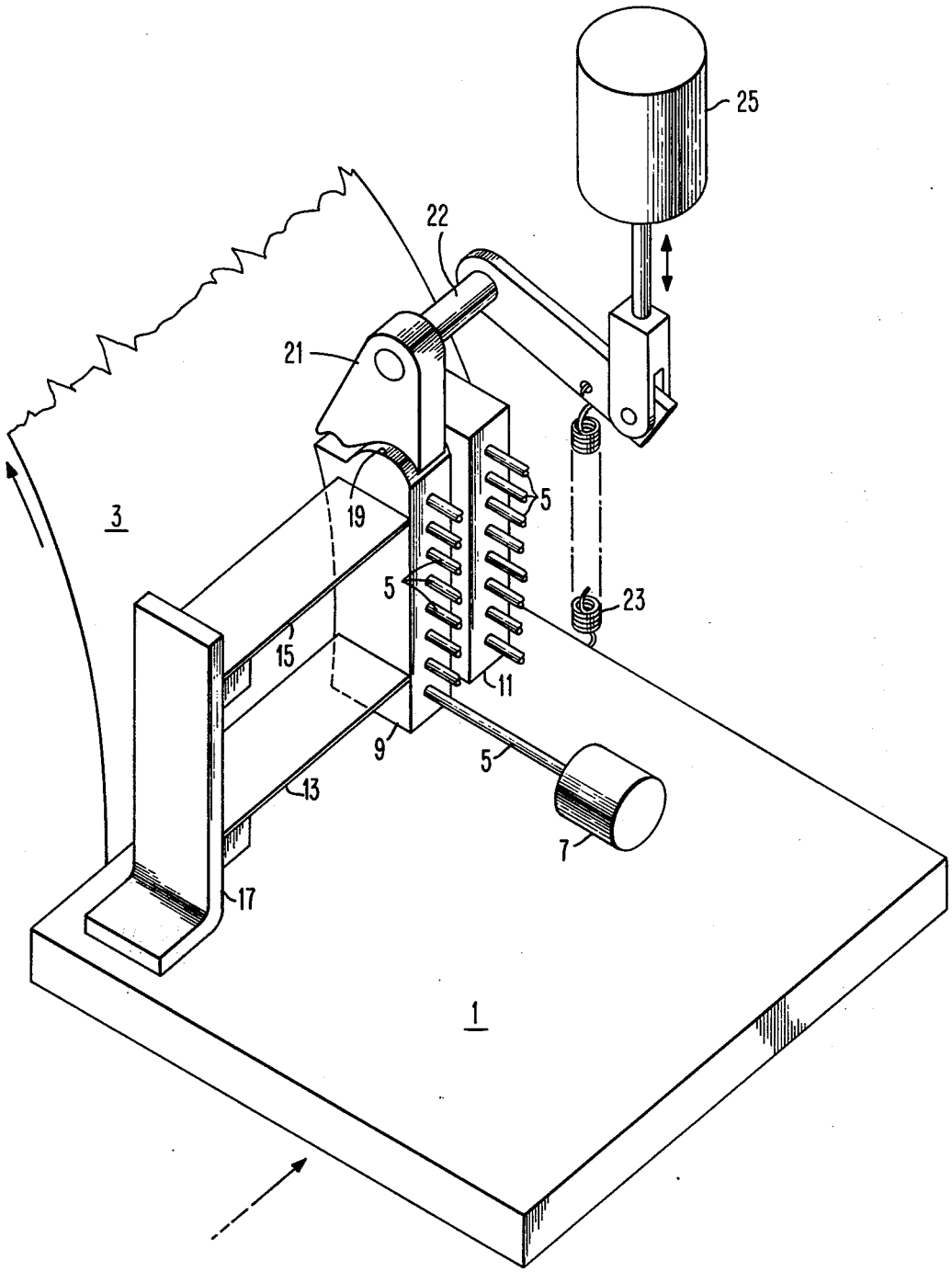
FIG. 1 is a diagrammatic illustration of a wire matrix printing device using translational wire guides to effect the two types of printing as previously described.

Referring now to FIG. 1 of the drawings, a wire matrix print head assembly is arranged to be moved laterally by a carrier 1 moving at a constant velocity along the line being printed, as shown by the arrow, that is to say, the print head is carried horizontally, for example, from left to right, to print across a line on a document 3. Printing is effected by the impact of selected pluralities of print wires 5, each of which is provided with a separate electromagnetic actuator such as 7, arranged so that when the actuator is energized, the associated print wire is driven forward to impact the paper. A suitable ribbon (not shown) is interposed between the document and the print wires or between the document and the platen which backs up the document. In either event, the impact of the print wire on the combination of document ribbon and platen causes a dot to be printed at the selected point on the document. As is well known in the printing art, by energizing various combinations of the actuators, combinations of the print wires can be actuated to thereby print a pattern corresponding to a selected character.

The print wires are maintained in predetermined spatial relationships by passing through wire guides 9 and 11, the guide 11 being rigidly attached to the carrier 1 by supporting means not shown in the drawings. The wire guide 9 is movable in a vertical plane, as a result of being supported by the set of cantilever springs 13 and 15, which have one end thereof anchored in a support 17, and having the other ends anchored in the movable wire guide 9.

The flexural members 13 and 15 are preloaded in such manner that an upper camming surface 19 on guide 9 bears upon a rotatable cam 21, and the parts are arranged so that, in the position shown, the print wires in guide 9 and the print wires in guide 11 are in horizontal alignment with each other. The shaft 22 carrying cam 21 rotates in a bearing (not shown) which is rigidly attached to the carrier 1.

Cam 21 is rotated to the position shown and normally maintained there by suitable biasing means such as the tension spring 23. A solenoid 25 is arranged so that when it is energized, it will rotate cam 21 so that cam 21 will depress the wire guide 9 thereby causing relative vertical displacement between the print wires in guide 9 and the print wires in guide 11. Thus the disposition of the print wires is selectively variable according as the solenoid 25 is energized or de-energized. It will be obvious to those skilled in the art that the electromagnetic solenoid may be dispensed with if manual operation is desired and a suitable manual operating lever can be used to rotate the cam 21.

Figure 2A:
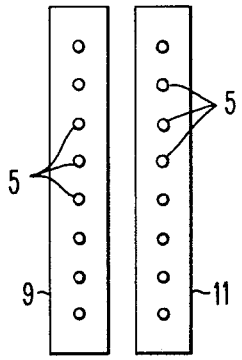
FIGS. 2A and 2B illustrate the manner in which one of the print wire guides is displaced with respect to the other to obtain the two different printing arrays.
Figure 2B:
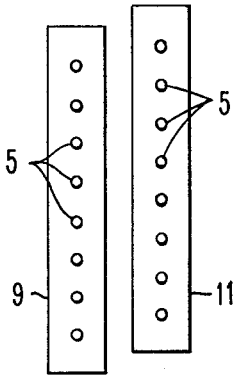

FIG. 2A of the drawings is a view showing how the print wires are normally aligned when the wire guides 9 and 11 are disposed in their first position, and FIG. 2B of the drawings shows the downward displacement of the wires in the wire guide 9, when the wire guide 9 is displaced vertically as described above in connection with FIG. 1.

With the wire guides in the position shown in FIG. 2A, seven lines of dots can be printed at high speed with each wire in a horizontal pair being fired alternately. When the solenoid 25 is energized, the wire guide 9 is pushed downward by a distance equal to half of the pitch between the vertical adjacent wires in the wire guides 9 and 11. Under these circumstances, the wires can then print 14 rows of dots. To obtain a pleasing character appearance, the horizontal spacing of the dots should be about half of that in the first case. If the printing speed is limited by the time required for any wire to strike the paper and recover, the printing speed in the second case will be about one quarter of that in the first case.

It will be understood by those skilled in the art, that the number of wires in the matrix is not limited to that described above.

DESCRIPTION OF A SECOND PREFERRED EMBODIMENT

Figure 3:
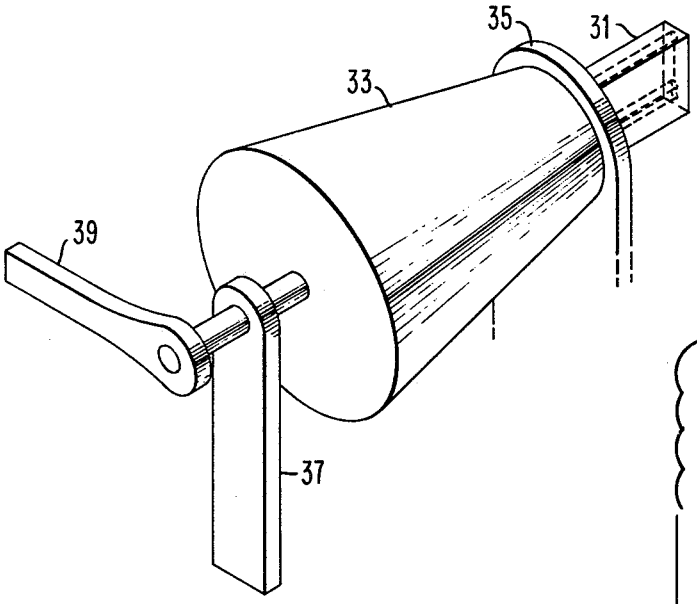
FIG. 3 is a diagrammatic view of one form of second embodiment of the invention in which the wire guide, together with print wire actuators and accessory equipment, is mounted in a rotatable housing so that the wire guide and the associated print wires can be rotated through specific angles to provide resultant arrays of the type required for the two varieties of printing.

Referring now to FIG. 3 of the drawings, there is shown a second embodiment of the invention in which a single array of print wires is arranged to be rotated into different angular relationships with respect to a reference which may be, for example, a vertical line on the document. A wire guide 31 is arranged at the front of the carrier, so that the wires when operated will impact paper, ribbon and platen in the fashion as shown in FIG. 1, and the wire guide together with the wire actuators and related equipment is included in a frustum body 33, supported at the front end by a bearing bracket 35 and at the rear end by a bearing bracket 37. The entire assembly may be rotated through a desired angle by operation of a position selector lever 39. The manner in which operation of lever 39 will rotate the wire guide 31 and its associated equipment through a predetermined angle will be manifest from the illustration. Electrical connections to the wire actuators contained in the casing 33 can be by means of flexible conductors, not shown, but whose use will be apparent to those skilled in the art.

The array of wires in wire guide 31 is such that when the wire guide 31 is disposed at a first angle with respect to the vertical, the array will provide a first number of dots in a vertical row corresponding to a prestige printing quality, in which a plurality of closely spaced dots are overlapped so that the lines formed thereby are relatively solid. When rotated to a second angular position, the relative location of the print wires in wire guide 31 is such that there are two print wires per horizontal line across the characters and the vertical pitch is twice the pitch of the dots in first position.

Figure 4:
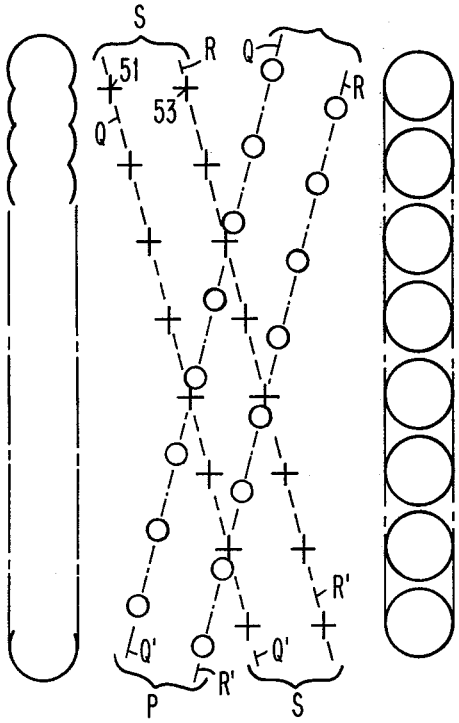
FIG. 4 is a diagrammatic view illustrating the positions which the print wires take when rotated, and also shows the relationship of the print wires to the dots produced by the wires in the two different printing configurations.

The general relationship of the wires in the two angular positions and the type of dot formations which occur as a result are illustrated in FIG. 4 of the drawings. In FIG. 4, the location and spacing of the print wires are shown in the two alternate angular positions which the wire guide 31 can occupy as a result of the rotation of selector lever 39. In the counterclockwise position designated by reference character S, for speed printing, the position of the print wires is indicated by the small crosses. It will be noted that the print wires are paired off horizontally, and in this position, operation of the print wires will cause a series of dots to be produced such as shown at the right-hand side of the figure, the dots being spaced apart by a predetermined amount and having a uniform pitch of the first value as shown.

When the array is rotated to the clockwise position designated by the reference character P, the print wires then occupy positions as shown by the small circles. Under these conditions, the print wires are not aligned horizontally, and if they are operated at appropriate times, will create vertical lines such as that shown at the left-hand side of the figure, where the line is solid as formed by overlapping dots spaced at one half of the pitch of the dots produced in the S or speed printing position.

In the S position, there are always two print wires (identified by small crosses) along a horizontal line on which dots are to be created, such as, for example, the wires 51 and 53. The first print wire serves all the odd dot positions (first, third and fifth dot, for instance, on the top line of an E). The second print wire serves all the even positions (second and fourth dot, for instance, on the top line of an E).

In the P position, there are twice as many horizontal lines on which dots can be placed, but there is only one print wire (identified by small circles) per horizontal line. Since in the P position the vertical resolution is doubled, the horizontal resolution should also be doubled to make characters appear really pleasing. Thus, four times as many points can be addressed in the P position, but the printing speed is only one quarter of the speed achieved in the S position.

There are two requirements to be fulfilled if the emitter and the logic for this type of printer are to be kept simple:

1. The horizontal distance between adjacent print wires on the axes RR′ and QQ′ (*h* in FIG. 5) must be in rational relationship to the emitter resolution, in order to use a simple emitter, responsive to lateral displacement of the print head along the print line.

2. The horizontal distance between the axes RR′ and QQ′ (equal to the distance between print wires on the same horizontal line in the S position) must be equal to the emitter resolution multiplied by a rational number, preferably an integer.

Generally speaking, it is desirable to have regular spacing of the horizontal lines on which dots can be placed in the P position as well as in the S position. If this spacing is V in the S position, it is V/2 in the P position.

Furthermore, it appears preferable to have the P position offset by the same angle from the vertical as the S position, but in opposite direction. It then follows that in the S position, horizontal lines are spaced from the center of rotation as follows:

$$\ldots -3V, -2V, -V, 0, +V, +2V, +3V + \ldots$$

considering negative spacings as those below the center of rotation and positive spacings as those above the center of rotation.

In the P position, the vertical spacing must be V/2, and consideration of symmetry demands that the horizontal lines be spaced from the center of rotation as follows:

$$\ldots -5V/4, -3V/4, -V/4, +V/4, +3V/4, +5V/4 \ldots$$

Figure 5:
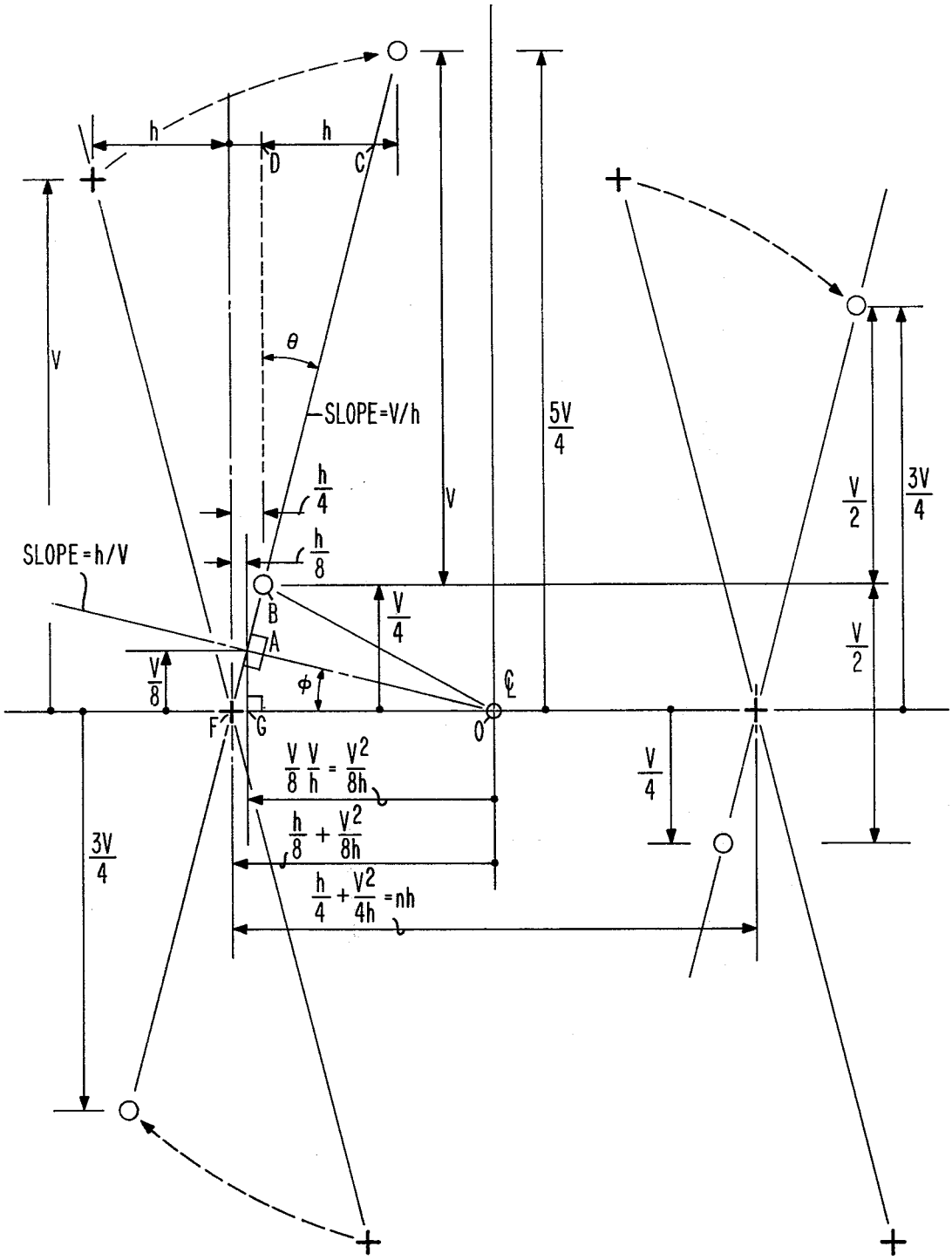
FIG. 5 illustrates certain of the geometrical relationships involved in the arrangement shown in FIGS. 3 and 4.

These relationships are apparent from consideration of FIG. 5.

If the horizontal distance between adjacent print wires on the axes QQ′ and RR′ is defined as $h$, the horizontal distance between the two columns in the S or P positions is nh, where $n$ is a rational number.

FIG. 5 illustrates the relationships between these varibles. From the similarity of the triangles involved, the spacing of the axes of the wire guides can be deduced. The angle $\theta$ of triangle DBC is equal to the angle $\phi$ of triangle AOF. These triangles are constructed by considering the relationships of the P and S positions of the print wire when it moves through the angle $2\phi$ from position F to the position B. To comply with the pitch requirements of V/2 for the P position, the wires must move either up or down a distance of V/4, as seen by the vertical height of point B in FIG. 5. Line OA bisects the isosceles triangle BOF, and the lower one of the two resultant right triangles is OAF.

Now consider the triangle OAG. This is a right triangle with the side GA equal to V/8 and the opposite angle $\theta$. To find the side OG, the side GA, which equals V/8, is divided by $h$/V, which latter value is equal to the tangent of $\phi$. Thus $$OG = V/h.V/8 = V^2/8h$$

The distance OF, which is the distance from the center of rotation O to the axis of the left column of print wires, is then $h/8 + V^2/8h$. The total distance between the two columns, previously defined as $nh$, is equal to $2(h/8 + V^2/8h)$ or $(h/4 + V^2/4h) = nh$.

Solving for $n$, $$n = 1/4 + V^2/4h^2$$

The slope V/$h$ can then be shown to be equal to $\sqrt{4n-1}$. After choosing $n$, determine V/$h$. For $n = 4$, $V/h = \sqrt{16-1} = 3.87$. The S and the P positions are defined by the slope $$\phi = \theta = \arctan (V/h)$$

Among the many possible solutions, $n = 2.5$, $n = 6.5$, and $n = 20.5$ are recognized as potentially attractive. The geometry is developed as follows:

| n | 2.5 | 6.5 | 20.5 |
|---|---|---|---|
| $V/h = \sqrt{4n-1}$ | 3 | 5 | 9 |
| $nh = nV/\sqrt{(4n-1)}$ | 5V/6 | 13V/10 | 41V/18 |
| Required Potential Firing Pulses per distance h | 2 | 4 | 2 |
| per distance nh | 5 | 26 | 41 |

The solution with $n = 6.5$ appears particularly attractive since it readily permits a "square" matrix (equal dot spacing on the paper in horizontal and vertical direction) and leads to a suitable horizontal distance between the two axes of print wires.

It will be apparent from the foregoing that the present invention provides simplified means for selectively achieving either high-quality or high-speed printing in a wire matrix printer by appropriately displacing the printing wires in an array.

While the invention has been particularly shown and described with reference to preferred embodiments thereof, it will be understood by those skilled in the art that the foregoing and other changes in form and details may be made therein without departing from the spirit and scope of the invention

We claim:

1. In a matrix printer for printing along a print line on a document, a print head mounted to move along said print line, said print head having a plurality of longitudinally movable print wires operable to impact said document for printing thereon, and guide means on said print head adjacent said document receiving said print wires and positioning them in two arrays arranged in spaced relation, said guide means being translatable to change at least the vertical alignment of one of said arrays relative to the other.

2. The combination as claimed in claim 1, further comprising means for displacing the two arrays in a vertical direction only.

3. The combination as claimed in claim 1, further characterized by means for rotating said guide means from a first to a second position to change the vertical alignment of said arrays.

4. A print head for a wire matrix printer comprising, in combination, a first wire guide containing a first linear array of print wires, a second wire guide containing a second linear array of print wires, said first wire guide being fixedly attached to said print head, said second wire guide being slidably attached to said print head for linear movement relative to said first wire guide, and means for moving said second wire guide with respect to said first wire guide.

5. A print head as claimed in claim 4 further including motion limiting means in which the motion of said second wire guide is equal to one half the pitch of the wires in the arrays.

6. A print head for a wire matrix printer comprising, in combination, a wire guide containing two linear arrays of print wires, support means supporting said wire guide for rotation about an axis perpendicular to a document to be printed upon, and means for rotating said guide between a first and a second angular position, said array providing dot printing at a first pitch when in said first angular position, and providing dot printing at a second pitch when in said second angular position.

7. The combination claimed in claim 6 in which said rotating means rotates through an angle such that said second pitch is twice said first pitch.

* * * * *